US006158979A

United States Patent [19]

Couetoux et al.

[11] Patent Number: 6,158,979

[45] Date of Patent: Dec. 12, 2000

[54] DEVICE FOR FIXING A MOTOR-FAN UNIT ON A MOTOR VEHICLE ELEMENT, IN PARTICULAR A HEAT EXCHANGER

[75] Inventors: Hervé Couetoux, St. Rémy-leès-ch.; Mathieu Chanfreau; Stéphane Moreau, both of Paris, all of France

[73] Assignee: Valeo Climatisation and Valeo Thermique Moteur, la Verriere, France

[21] Appl. No.: 09/254,970

[22] PCT Filed: Oct. 21, 1999

[86] PCT No.: PCT/FR98/01474

§ 371 Date: Mar. 16, 1999

§ 102(e) Date: Mar. 16, 1999

[87] PCT Pub. No.: WO99/04172

PCT Pub. Date: Jan. 28, 1999

[30] Foreign Application Priority Data

Jul. 17, 1997 [FR] France ..... 97 09096

[51] Int. Cl.[7] ..... F04B 39/02; F04B 35/04

[52] U.S. Cl. ..... 417/360; 417/367; 417/369; 417/423.15; 165/121; 165/DIG. 302

[58] Field of Search ..... 417/360, 366, 417/367, 369, 423.15; 165/122, 121, DIG. 302, DIG. 316, DIG. 317

[56] References Cited

U.S. PATENT DOCUMENTS

| | | | |
|---|---|---|---|
| 2,951,634 | 9/1960 | Koch | 417/369 |
| 4,805,868 | 2/1989 | Claude | 248/603 |
| 5,180,279 | 1/1993 | McLane-Goetz et al. . | |
| 5,299,554 | 4/1994 | Mohring . | |
| 5,492,456 | 2/1996 | Knight et al. | 417/360 |
| 5,577,888 | 11/1996 | Capdevila et al. . | |
| 5,875,836 | 9/1960 | Nakamura | 165/122 |

FOREIGN PATENT DOCUMENTS

| | | |
|---|---|---|
| 569 738 | 11/1993 | European Pat. Off. . |
| 39 42 647 | 6/1991 | Germany . |
| 44 41 649 | 5/1996 | Germany . |
| 195 07 123 | 9/1996 | Germany . |

OTHER PUBLICATIONS

Patent Abstracts of Japan vol. 97, No. 2, Feb. 28, 1997 & JP 08 284896 A (Nippondenso), Oct. 29, 1996.

International Search Report dated Sep. 25, 1998.

*Primary Examiner*—Charles G. Freay
*Attorney, Agent, or Firm*—Morgan & Finnegan, LL

[57] ABSTRACT

A device for fixing a motor-fan unit to a heat exchanger comprising an inner support forming a housing for fixing the motor casing of the motor-fan unit and having a lateral opening providing a passage for ancillary equipment of the motor, an outer support surrounding the inner support and adapted to be fixed to the heat exchanger and connecting armatures joining the inner support and the outer support

16 Claims, 3 Drawing Sheets

DEVICE FOR FIXING A MOTOR-FAN UNIT ON A MOTOR VEHICLE ELEMENT, IN PARTICULAR A HEAT EXCHANGER

This application is a 371 of PCT/FR98/01474 filed Jul. 8, 1998.

BACKGROUND OF THE INVENTION

The invention concerns a device for fixing a motor-fan unit to a component of a motor vehicle, in particular a heat exchanger through which air flows, in particular to a radiator for cooling a motor vehicle internal combustion engine.

The invention is more particularly concerned with a device of the above kind in which the motor-fan unit includes an electric motor having a casing with openings for air to pass through and including ancillary equipment disposed at the periphery of the casing in the flow of air.

Fixing devices of the above type are already known per se and are used for mounting a motor-fan unit, in turn consisting of an electric motor and a fan, in front of the body of the heat exchanger to create a flow of air through the heat exchanger and thereby improve heat exchange between the flow of air and a fluid flowing through the heat exchanger.

The fixing device must not impede the flow of air and it must allow cooling of the electric motor itself and the ancillary equipment of the motor.

This ancillary equipment, or accessory, can in particular be a heatsink for electronics associated with the motor itself.

As the ancillary equipment is disposed at the periphery of the motor casing the air must be able to flow across it without it impeding the flow of air.

The main drawbacks of fixing devices known per se are their complex structure, the fact that they impede the flow of air and the fact that they do not allow optimum cooling of the electric motor and, where applicable, its ancillary equipment.

An aim of the invention is to overcome the above drawbacks.

BRIEF SUMMARY OF THE INVENTION

To this end it proposes a device for fixing a motor-fan unit to a component of a motor vehicle, in particular to a heat exchanger through which flows a flow of air, wherein the motor-fan unit includes an electric motor having a casing with air openings and ancillary equipment at the periphery of the casing and adapted to have the flow of air pass over it, characterised in that it includes an inner support forming a housing for fixing the casing of the motor and having a lateral opening providing a passage for the ancillary equipment of the motor, an outer support surrounding the inner support and adapted to be fixed to the component of the vehicle, and connecting armatures joining the inner support and the outer support.

This provides a fixing device with a simple structure enabling secure fixing of the motor-fan unit and optimum cooling of the motor and its ancillary equipment.

The inner support is preferably in the general form of a circular ring adapted to receive a circular flange forming part of the casing of the motor, the circular ring being interrupted to provide the opening providing a passage for the ancillary equipment of the motor.

The invention applies in particular to the situation in which the motor casing has a cylindrical lateral wall with air inlet openings. In this case the inner support includes air collecting means adapted to channel a portion of the flow of air towards the air inlet openings.

In one embodiment of the invention the air collecting means include scoop-shaped cavities in the inner support adapted to deflect the flow of air radially towards the air inlet openings of the casing.

When the inner support is a circular ring, the scoop-shaped cavities are in the circular ring at the junction of a cylindrical wall and an annular face thereof.

In another embodiment of the invention the air collecting means comprise gaps between the inner support and the cylindrical motor casing.

When the inner support is a circular ring, the gaps are circular arc-shaped and between the cylindrical wall of the casing and an inner cylindrical wall of the inner ring.

In accordance with another feature of the invention the motor casing is fixed to the inside support by lugs.

In a preferred embodiment of the invention the outer support is in the general form of a circular ring.

In this case the outer support in the form of a circular ring is concentric with the inner support in the form of a circular ring and the connecting armatures extend radially between the inner support and the outer support.

The connecting armatures each advantageously have two arms connected by spacers.

Whatever their structure, the connecting armatures are preferably aerodynamically profiled sections.

In accordance with another feature of the invention the ancillary equipment of the motor is a heatsink for cooling electronic components associated with the motor.

The heatsink is advantageously carried by an extension of a circular flange that is part of the motor casing.

BRIEF DESCRIPTION OF THE DRAWINGS

The following description is given by way of example with reference to the accompanying drawings, in which.

DETAILED DESCRIPTION OF DRAWINGS

Figure 1:
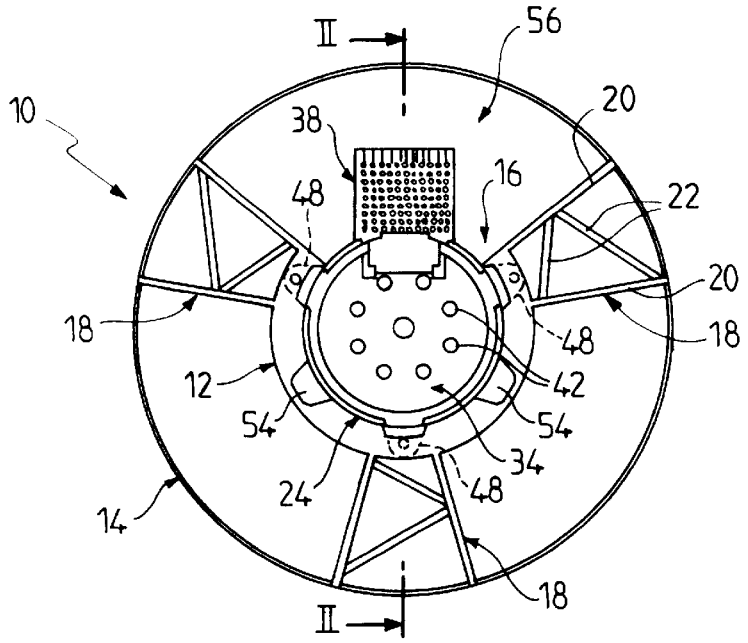
FIG. 1 is a front view of a first embodiment of a fixing device in accordance with the invention, the device being shown with a flange of the motor carrying ancillary equipment.

FIG. 1 shows a fixing device 10 in accordance with the invention comprising an inner support 12 having the general shape of an open circular ring and an outer support 14 in the form of a complete circular ring concentric with the circular ring 12.

The circular ring of the inner support 12 subtends an angle substantially corresponding to three-quarters of a complete circle and therefore defines a lateral opening 16 the function of which will be described later.

The supports 12 and 14 are joined by three connecting armatures 18 disposed at 120° to each other about the centre C of the support 12. Each armature 18 has two radial arms 20 interconnected by two spacers 22.

Figure 2:
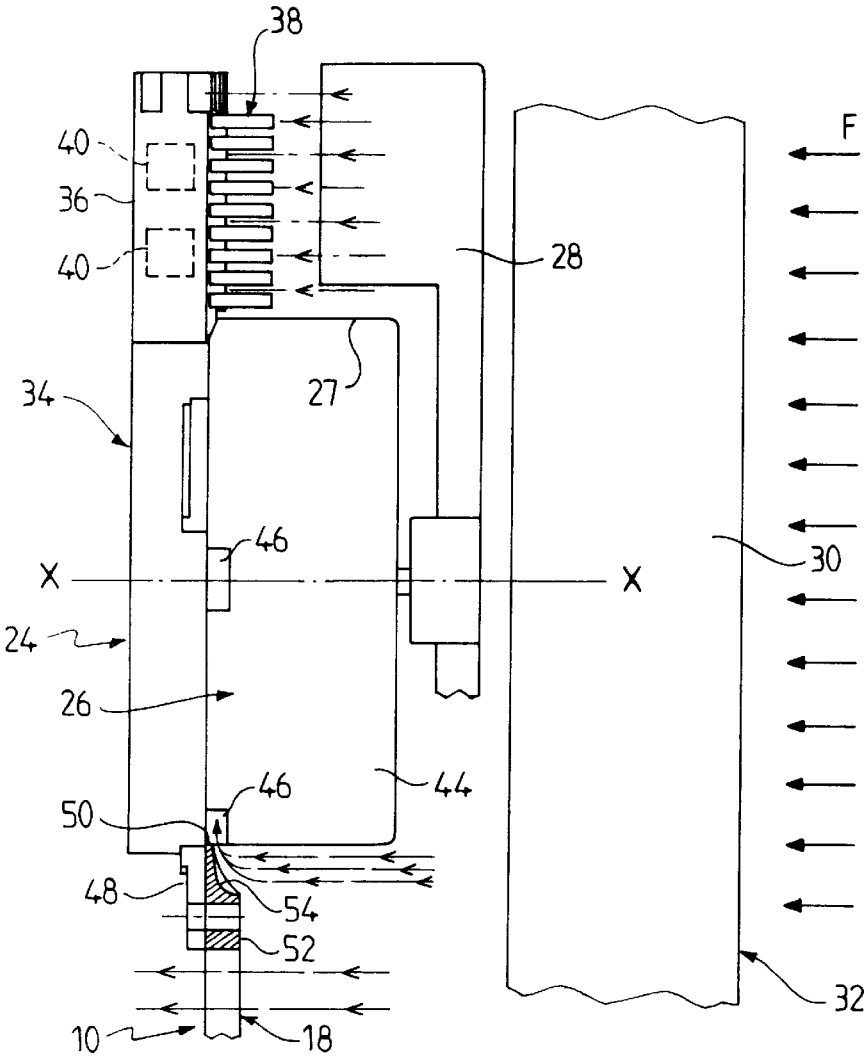
FIG. 2 is a part-view in section taken along the line II—II in FIG. 1 and to a larger scale, also showing the motor-fan unit and its fan and the heat exchanger.

The inner support 12 is used to support and to fix a motor-fan unit 24 seen better in FIG. 2 and which comprises an electric motor 26 rotating a fan 28 about an axis X—X passing through the centre C and perpendicular to the plane of the supports 12 and 14.

The outer support 14 is adapted to be fixed by appropriate means (not shown) to the body 30, also known as the "bundle", of a heat exchanger 32 (FIG. 2), in this example a cooling radiator of a motor vehicle internal combustion engine or any other component of the motor vehicle, such as the support incorporating the heat exchangers.

The electric motor 26 is adapted to drive the fan 28 to draw a flow of air (arrows F) through the body 30 of the heat exchanger.

The motor 26 of the motor-fan unit has a casing 27 and a generally circular flange 34 (casing end wall) with a radial extension 36 for supporting ancillary equipment of the motor, in this example a heatsink 38 for cooling electro components 40 (FIG. 2) associated with the motor control circuit. The ancillary equipment 38 is at the periphery of the casing and is adapted to have some of the air to which movement is imparted by the fan 28 flow across it for optimum cooling of the electronic components 40.

In this example the flange 34 also includes eight openings 42 for air to pass through, as shown in FIG. 1. The openings are on a circle with centre C.

The casing 27 of the electric motor 26 further includes a cylindrical wall 44 (FIG. 2) with air inlet openings 46 adapted to receive a portion of the flow of air to assure internal cooling of the motor. The air entering via the openings 46 then leaves via the openings 42.

As shown in FIGS. 1 and 2, the flange 34 has three integral fixing lugs 48 spaced by 120° adapted to be fixed to an inner support 12 in the form of a ring by appropriate means (not shown) such as screws or the like. The inner support 12 has an inner cylindrical wall 50 whose diameter substantially corresponds to the outside diameter of the wall 44 of the casing and an annular face 52 adapted to be exposed to the flow of air F.

The inner support 12 in the form of an incomplete ring incorporates a plurality of scoop-shaped cavities 54 (see FIGS. 1 and 2) at the junction of the cylindrical wall 50 and the annular face 52 and facing the openings 46 in the casing. The cavities 50 collect some of the flow of air and divert it radially towards the air inlet openings 46 in the casing, as shown in FIG. 2. Thus a small portion of the flow of air is deflected by the scoop-shaped cavities 54 into the interior of the electric motor, from which it is subsequently evacuated via the evacuation openings 42 in the casing.

The motor can be cooled internally in a manner that is known per se, for example as described in document EP 0 569 738.

The lateral opening 16 of the inner support 12 (FIG. 1) delimits with two of the connecting armatures 18 a housing 56 for the extension 36 of the flanges 34, i.e. for the ancillary equipment 38.

The ancillary equipment is therefore exposed directly to the flow of air F from the heat exchanger 30, which facilitates cooling the electronic components 40.

The armatures 18 are made from profiled members offering minimum air resistance so as not to interfere with the flow of air and to offer minimum resistance to circulation of the flow of air.

The outer support 14 can be fixed to the heat exchanger 30 by any appropriate means. In particular the support 14 can be a shroud fixed to the heat exchanger 32 to channel the flow of air through its body bundle 30.

Another embodiment of the invention will now be described with reference to FIGS. 3 to 6.

The structure of the device 10 is similar to that from FIG. 1. The main difference is that the scoop-shaped cavities 54 providing air collecting means in the previous embodiment are dispensed with here.

The air flows instead through circular arc-shaped gaps 58 (FIG. 5) between the cylindrical wall 44 of the casing of the motor and the inside cylindrical wall 50 of the circular ring forming the inner support 12.

There must therefore be a slight difference between the diameters of the two cylindrical walls to form a gap through which th e air can pass.

Figure 3:
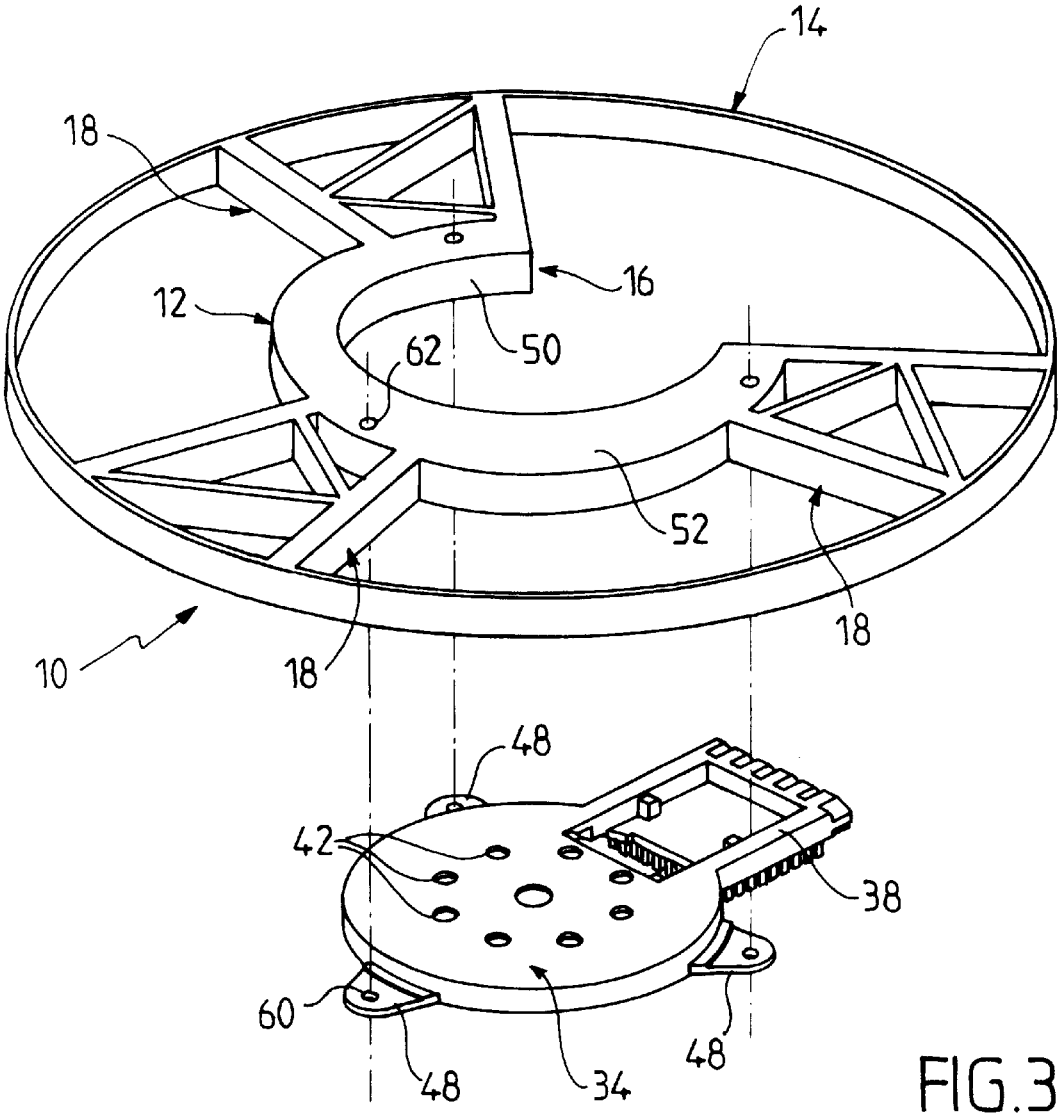
FIG. 3 is an exploded partial view in perspective of a fixing device and of a flange in a second embodiment of the invention.
Figure 4:
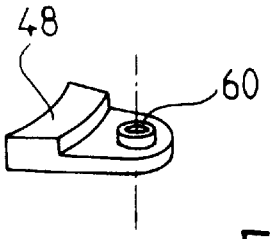
FIG. 4 shows a fixing lug of the flange from FIG. 3 to a larger scale.
Figure 5:
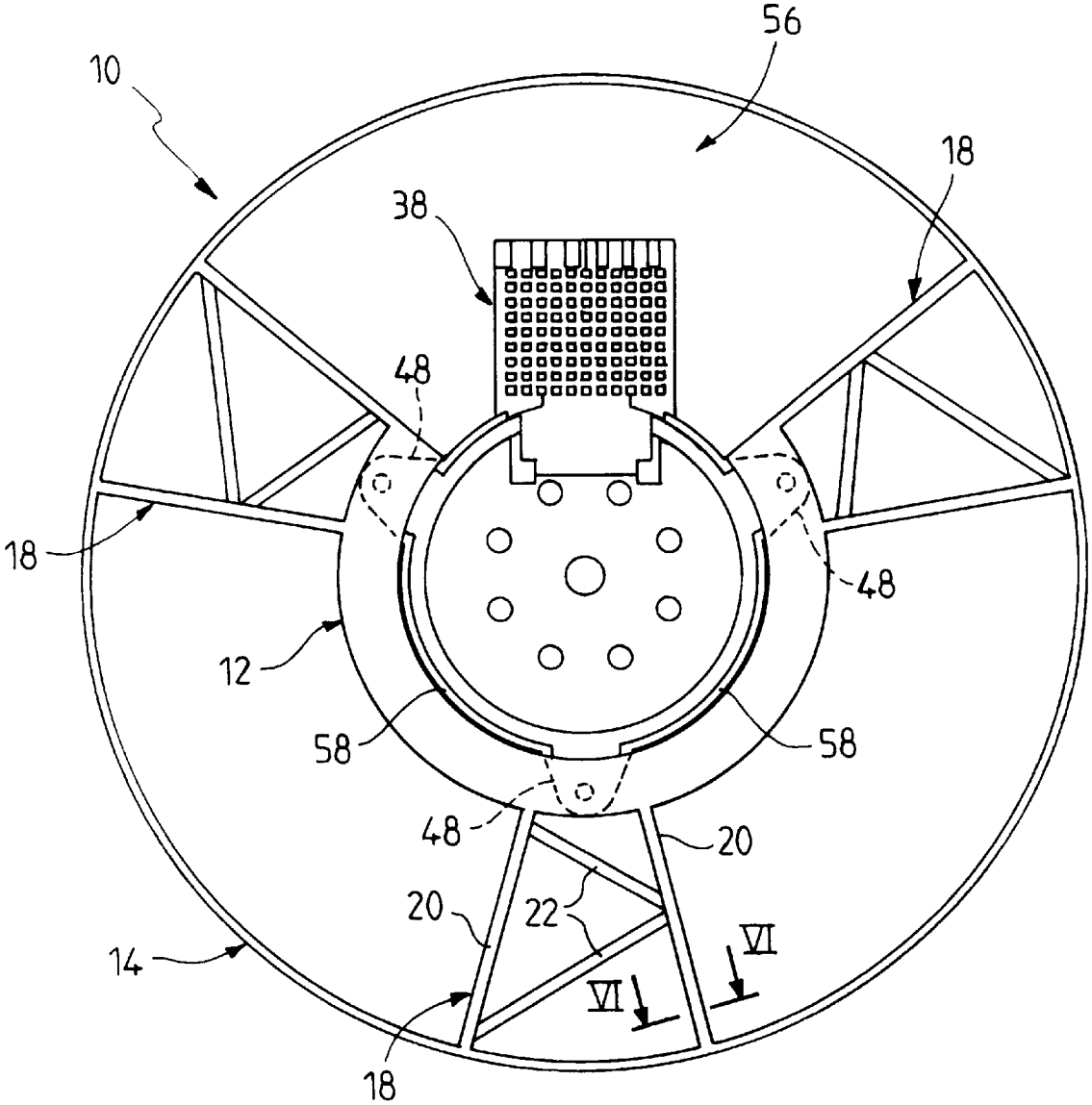
FIG. 5 is a front view of the device from FIG. 3.

FIGS. 3 and 4 show m ore clearly the structure of the lugs 48 previously described. Each lug 48 incorporates a hole 60 which is lined up with a corresponding hole 62 in the inner support 12.

Figure 6:
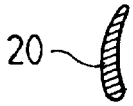
FIG. 6 is a view in section taken along the line VI—VI in FIG. 5.

FIG. 6 shows the profile of a radial arm 20 of a spacer 18. The profile is aerodynamically shaped, typically aerofoil-shaped, to offer minimum resistance to the flow of air F.

In the two embodiments described the device 10 is preferably moulded in one piece from a plastics material.

Of course, the invention is not limited to the embodiment described previously by way of example.

Thus it will be appreciated that the shape of the fixing device can be modified in many ways, provided that it assures effective fixing of the motor-fan unit to the vehicle and facilitates the flow of air not only through the heat exchanger but also across the electric motor of the motor-fan unit and its ancillary equipment.

What is more, the ancillary equipment of the motor is not necessarily limited to a heatsink for cooling electronic components and its position relative to the casing of the motor can be changed.

What is claimed is:

1. A device for fixing a motor-fan unit to a component of a motor vehicle through which flows a flow of air, wherein the motor-fan unit includes an electric motor having a casing with air openings and ancillary equipment at the periphery of the casing and adapted to have the flow of air pass over the ancilliary equipment, comprising an inner support forming a housing for fixing the casing of the motor and having a lateral opening providing a passage for the ancillary equipment of the motor, an outer support surrounding the inner support and adapted to be fixed to the component of the vehicle, and connecting armatures joining the inner support and the outer support.

2. A device according to claim 1 wherein the inner support is in the general form of a circular ring adapted to receive a circular flange forming part of the casing of the motor, the circular ring being interrupted to provide the opening providing a passage for the ancillary equipment of the motor.

3. A device according to claim 1 wherein the casing of the motor has a cylindrical lateral wall with air inlet openings, and the inner support includes an air collector configured to channel a portion of the flow of air towards the air inlet openings.

4. A device according to claim 3 wherein the air collector includes scoop-shaped cavities in the inner support adapted to deflect the flow of air radially towards the air inlet openings of the casing.

5. A device according to claim 4 wherein the scoop-shaped cavities are in the circular ring at the junction of a cylindrical wall and an annular face thereof.

6. A device according to claim 3 wherein the air collector comprises gaps between the inner support and the cylindrical wall of the casing of the motor.

7. A device according to claim 6 wherein the gaps are circular arc-shaped and between the cylindrical wall of the casing and an inner cylindrical wall of the inner ring.

8. A device according to claim 1 wherein the motor casing is fixed to the inside support by lugs.

9. A device according to claim 1 wherein the outer support is in the general form of a circular ring.

10. A device according to claim 9 wherein the outer support in the form of a circular ring is concentric with the inner support in the form of a circular ring and the connecting armatures extend radially between the inner support and the outer support.

11. A device according to claim 10 wherein the connecting armatures each have two arms connected by spacers.

12. A device according to claim 1 wherein the connecting armatures are aerodynamically profiled sections.

13. A device according to claim 1 wherein the ancillary equipment of the motor is a heatsink for cooling electronic components associated with the motor.

14. A device according to claim 13 wherein the ancillary equipment is carried by an extension of a circular flange that is part of the motor casing.

15. A device according to claim 1 wherein the outer support constitutes a shroud for the fan of the motor-fan unit.

16. A device according to claim 1 wherein the component is a heat exchanger.

* * * * *